US005578749A

United States Patent [19]

Mogaki

[11] Patent Number: 5,578,749

[45] Date of Patent: Nov. 26, 1996

[54] THROTTLE-OPENING DETECTING APPARATUS FOR AN INTERNAL COMBUSTION ENGINE

[75] Inventor: Shinichi Mogaki, Tokyo, Japan

[73] Assignee: Mitsubish Denki Kabushiki Kaisha, Tokyo, Japan

[21] Appl. No.: 621,989

[22] Filed: Mar. 26, 1996

[30] Foreign Application Priority Data

Aug. 23, 1995 [JP] Japan ..... 7-214961

[51] Int. Cl.[6] ..... F02D 9/08; F02D 45/00

[52] U.S. Cl. ..... 73/118.1; 123/478; 364/431.05

[58] Field of Search ..... 73/116, 117.2, 73/117.3, 118.1, 118.2; 364/431.05; 123/478

[56] References Cited

U.S. PATENT DOCUMENTS

| | | | |
|---|---|---|---|
| 4,515,009 | 5/1985 | Hasegawa et al. | 73/118.1 |
| 4,581,924 | 4/1986 | Otobe et al. | 73/118.1 |
| 4,951,206 | 8/1990 | Kyohzuka | 73/118.1 |
| 5,113,692 | 5/1992 | Kouta | 73/117.3 |
| 5,127,263 | 7/1992 | Iizuka | 73/118.1 |
| 5,157,956 | 10/1992 | Isaji et al. | 73/118.1 |
| 5,220,828 | 6/1993 | Sodeno et al. | 73/118.1 |
| 5,229,957 | 7/1993 | Hahn et al. | 73/118.1 |
| 5,408,871 | 4/1995 | Lieder et al. | 73/118.1 |
| 5,447,134 | 9/1995 | Yokoyama | 73/118.1 |
| 5,473,936 | 12/1995 | Sasakura et al. | 73/118.1 |

FOREIGN PATENT DOCUMENTS 56-107926 8/1981 Japan .

*Primary Examiner*—Richard Chilcot
*Assistant Examiner*—George M. Dombroske
*Attorney, Agent, or Firm*—Sughrue, Mion, Zinn, Macpeak & Seas

[57] ABSTRACT

An throttle-opening detecting apparatus for an internal combustion engine includes a fully-closed state value learning unit for storing and updating as a fully-closed state learned value a minimum value of an output of a throttle-opening sensor, and a judgment unit for judging the fully closed state of the throttle valve based on comparison of the throttle-opening sensor output and the fully-closed state learned value. The judgment unit includes a first element for judging the throttle valve as being in the fully closed state when the throttle-opening sensor output is less than a first judging value which is obtained by adding a first threshold value to the learned value, and a second element for judging, when the throttle-opening sensor output is greater than the first judging value and less than a second judging value which is obtained by adding a second threshold value to the learned value, the throttle valve as being in the fully closed state after lapse of a predetermined time.

4 Claims, 6 Drawing Sheets

THROTTLE-OPENING DETECTING APPARATUS FOR AN INTERNAL COMBUSTION ENGINE

BACKGROUND OF THE INVENTION

1. Field of the Invention

The present invention relates to an apparatus for detecting a fully closed state of a throttle valve of an engine, and more particularly, to a throttle-opening detecting apparatus which can judge if the throttle valve is in its fully closed state based on the output of a throttle-opening sensor.

2. Description of Related Art

As a general apparatus for detecting idling of engine, there is known a throttle opening detecting apparatus disclosed in Japanese Utility Model Laid-Open No. 59-52045. The apparatus is equipped with an idle switch which is turned on when the throttle valve is fully closed, and when the idle switch is operated, it is judged that the engine is in the idling state. However, a structure such as this has the disadvantage that the cost of production increases, because it requires the idle switch and the wiring for the switch.

Also, disclosed in Japanese Patent Publication No. 63-15467 and Japanese Patent Laid-Open No. 4-241762 are idling-state detecting apparatuses which learn and store, with the use of a microcomputer, the fully closed state of a throttle valve detected by the throttle-opening sensor at the time of predetermined conditions where the throttle valve is fully closed, and judge that the throttle valve is in the fully closed state, when the difference between the stored learned value and the detected value of the throttle-opening sensor becomes less than a predetermined value.

A conventional throttle-opening detecting apparatus will hereinafter be described in reference to FIGS. 6 and 7.

In FIG. 6, an engine 1 has a plurality of cylinders (only one cylinder shown) each provided with a combustion chamber 2. An intake pipe 3 is connected with the combustion chamber 2 for supplying thereto intake air or a fuel/air mixture. The intake pipe 3 is provided with an air flow sensor 5 for sensing a flow rate of intake air sucked into each combustion chamber 2 via the intake pipe 3. A throttle valve 6 is disposed in the intake pipe 3 and moved to open and close for controlling the flow rate of intake air through the intake pipe 3 in response to an accelerator pedal (not shown). A surge tank 7 is connected to the intake pipe 3 for stabilizing the quantity of an intake air supplied to each cylinder through the intake pipe 3.

An intake manifold 8 is connected at its one end with the surge tank 7 and at its other ends with the respective combustion chambers 2 of the cylinders. A fuel injection valve 9 for injecting fuel into intake air is mounted in the intake manifold 8 so that an injection nozzle of the injection valve 9 is directed toward a downstream side of the intake manifold 8. In addition, in order to control an idle intake quantity at the time when the degree of opening of the throttle valve 6 is of a minimum value, i.e., at the time of idling, an idle intake pipe 10 of a small diameter is connected with the intake pipe 3 so as to bypass the throttle valve 6. The degree of opening of the idle intake pipe 10 is controlled by an idle intake control valve 11, which is provided in the idle intake pipe 10, so that the engine speed at the time of idling is maintained at a predetermined value. Furthermore, there are provided a throttle-opening sensor 13 for sensing the degree of opening of the throttle valve 6 and an engine-speed sensor 14 for sensing the rotational speed of the engine.

The air flow sensor 5, the fuel injection valve 9, the idle intake control valve 11, the throttle-opening sensor 13, and the engine-speed sensor 14 are all connected to a engine control unit 12 which in turn controls the fuel injection valve 9 and the idle intake control valve 11 based on output signals from these sensors.

Now, the throttle-opening sensor and a fully-closed state detector will be described in reference to FIG. 7. The throttle-opening sensor 13, shown in FIG. 7, outputs voltage proportional to the degree of opening of the throttle valve 6 which is opened and closed in response to the operation of the accelerator pedal. A general internal structure of the throttle-opening sensor 13 is the same as a potential meter, as shown in FIG. 7, and a slidable contact **13*b* moves on and along a resistor 13*a* in synchronization with the throttle valve 6, whereby a divided voltage is output from an output terminal 13*c*. The opposite ends of the resistor 13*c*** are connected to a power supply terminal and a ground terminal, respectively.

Here, it is to be noted that the range between the opposite ends of the resistor **13*a* is generally set greater than the range where the movable contact 13*b* is moved by rotation of the throttle valve 6**.

The fully closed state of the throttle valve 6 is detected by the fully-closed state detector which is constituted by a microcomputer, etc. The fully-closed state detector 15 takes in the output voltage of the throttle-opening sensor 13 through the output terminal **13*c* and also takes in various states of the engine, for example, the engine speed detected by the engine-speed sensor 14, the air flow sensor output, etc. Based on these outputs, the fully-closed state detector judges whether a predetermined condition is established, and learns and stores the degree of opening of the fully closed state of the throttle valve 6** based on the output value of the throttle-opening sensor when the predetermined condition is established.

A fully-closed state judging value is obtained by adding a predetermined value to the learned value of the degree of opening of the fully closed state of the throttle valve stored. If the output value of the throttle-opening sensor is less than the fully-closed state judging value, the fully-closed state detector 15 will judge that the throttle valve is in the fully closed state.

However, a conventional detector such as described above has following problems.

In general, in the case where the throttle valve is opened and closed, the output value of the throttle-opening sensor does not become the same value even when the throttle valve is fully closed. This is because the output value is influenced by the structures, the materials, and the temperatures of the throttle valve and the throttle-opening sensor. As a structural influence of the throttle-opening sensor, it can be given that the positions of the throttle valve and the throttle-opening sensor differ each time the throttle valve is fully closed. The reason that the values of the fully closed states thus differ in that every full-closing operation is that the throttle valve and the throttle-opening sensor are a rotating body and they require play on an axis of rotation.

In addition, for a reason such as this, the output value of the throttle-opening sensor at the time of the fully closed state varies depending upon the speed when the throttle valve is closed or a change with the passage of time.

Therefore, in the conventional fully-closed state detector, in order to correctly judge the fully closed state of the throttle valve, a predetermined fixed value for judging the fully closed state must be set in view of all variations in the output value of the fully closed state of the throttle-opening sensor resulting from variations in the structure, material, temperature, and changes in settings of the throttle valve and the throttle-opening sensor over time, and hence the judgment value is set to a value greater than an actual value of the fully closed state. For this mason, the number of cases, where the throttle valve is judged as being in the fully closed state although it is open, is increased in the judgment of the fully closed state which uses the aforementioned fully-closed state judging value.

For this reason, in the idle speed control for maintaining engine speed constant, which is performed, for example, at the time of idling of the engine, the engine speed at the time of the fully closed state of the throttle valve (at the time of idling) must be fed back as one of the conditions for feeding back the engine speed and controlling a quantity of intake air of the engine. When, under such a condition, the throttle valve is judged as being in the fully closed state although it is open, as described above, control is performed such that the effective cross sectional area of the bypass passage is reduced by the idle intake control value 11. When the throttle valve is fully closed in such a situation, the engine speed is reduced because the bypass passage has been narrowed, and in the worst case there is the possibility that the engine stalls. In addition, such a mistaken detection of the fully closed state of the throttle valve constitutes an obstacle to the other controls, for example, all the controls in which switching is effected based on whether the throttle valve is fully closed, such as fuel control, ignition timing control, and automatic speed change control, and consequently, there is the problem that the controllability of the engine gets worse.

SUMMARY OF THE INVENTION

An object of the present invention is to provide a throttle-opening detecting apparatus for an internal combustion engine in which the engine can be controlled more satisfactorily than in the above-described conventional apparatuses by making a judgment in view of all variations in a throttle-opening sensor output and increasing the frequency and rate at which the fully closed state of a throttle valve can be detected in a nearly actual fully-closed state thereof.

To achieve the foregoing and other objects and in accordance with the purpose of the present invention, there is provided a throttle-opening detecting apparatus for an internal combustion engine comprising:

a throttle-opening sensor for detecting a degree of opening of a throttle valve and generating a corresponding output signal;

fully-closed state value learning means for storing and updating as a fully-closed state learned value a minimum value of the output of the throttle-opening sensor;

judgment means for judging the fully closed state of the throttle valve based on comparison of the throttle-opening sensor output and the fully-closed state learned value;

the judgment means comprising:

first means for judging the throttle valve as being in the fully closed state when the throttle-opening sensor output is less than a first judging value which is obtained by adding a first threshold value to the learned value; and second means for judging, when the throttle-opening sensor output is greater than the first judging value and less than a second judging value which is obtained by adding a second threshold value to the learned value, the throttle valve as being in the fully closed state after lapse of a predetermined time.

With this arrangement, the fully closed state of the throttle valve is judged with the second judging value taking all variations of the output of the fully closed throttle valve into consideration, and with the first judging value less than the second judging value, where the frequency of the output values of an actual fully-closed point is taken into consideration. Therefore, the fully closed state is usually judged with the first judging value, and when the fully closed point widely varies due to various overlapped main factors, the fully closed state is judged with the second judging value. For this reason, a fully-closed state judging value for normal traveling can be set to a lower value, and the number of cases, where the fully closed state is judged when the throttle valve is in the state near to the fully closed state, is increased, and consequently, the engine can be more satisfactorily controlled than before.

In a preferred form of the present invention, when the throttle-opening sensor output is greater than the first judging value and less than the second judging value, the predetermined time is determined from a difference between the last detected value and the current detected value of the throttle-opening sensor output when the sensor output is less than the second judging value, or from an operating state of the engine.

With this arrangement, the number of mistake judgments caused by the second judging value can be reduced and the fully closed state can be accurately detected.

In another preferred form of the present invention, the minimum value of the throttle-opening sensor output, obtained from the time when the throttle valve is judged as being in the fully closed state, is updated as the learned value, and the throttle valve is judged as not being in the fully closed state when the output value of the throttle-opening sensor thereafter is greater than a value obtained by adding the updated learned value to the first threshold value.

With this arrangement, the first threshold value less than before can be used as a judging value from the fully closed state to the non-closed state, and the engine can be accurately controlled.

In a further preferred form of the present invention, when the output value of the throttle-opening sensor becomes greater than the second judging value, the updated learned value is updated to the learned value before the updating.

With this arrangement, the fully closed state after the throttle valve is opened is judged again based on the first learned value. As a consequence, the judgment of the fully closed state can be accurately made even when the output values of the throttle-opening sensor in the fully closed state differ depending upon the vehicle speed at which the throttle valve is fully closed.

BRIEF DESCRIPTION OF THE DRAWINGS

The above and other objects and advantages will become apparent from the following detailed description when read in conjunction with the accompanying drawings wherein.

DESCRIPTION OF THE PREFERRED EMBODIMENTS

A preferred embodiment of the present invention will hereinafter be described with reference to the accompanying drawings.

Figure 1:
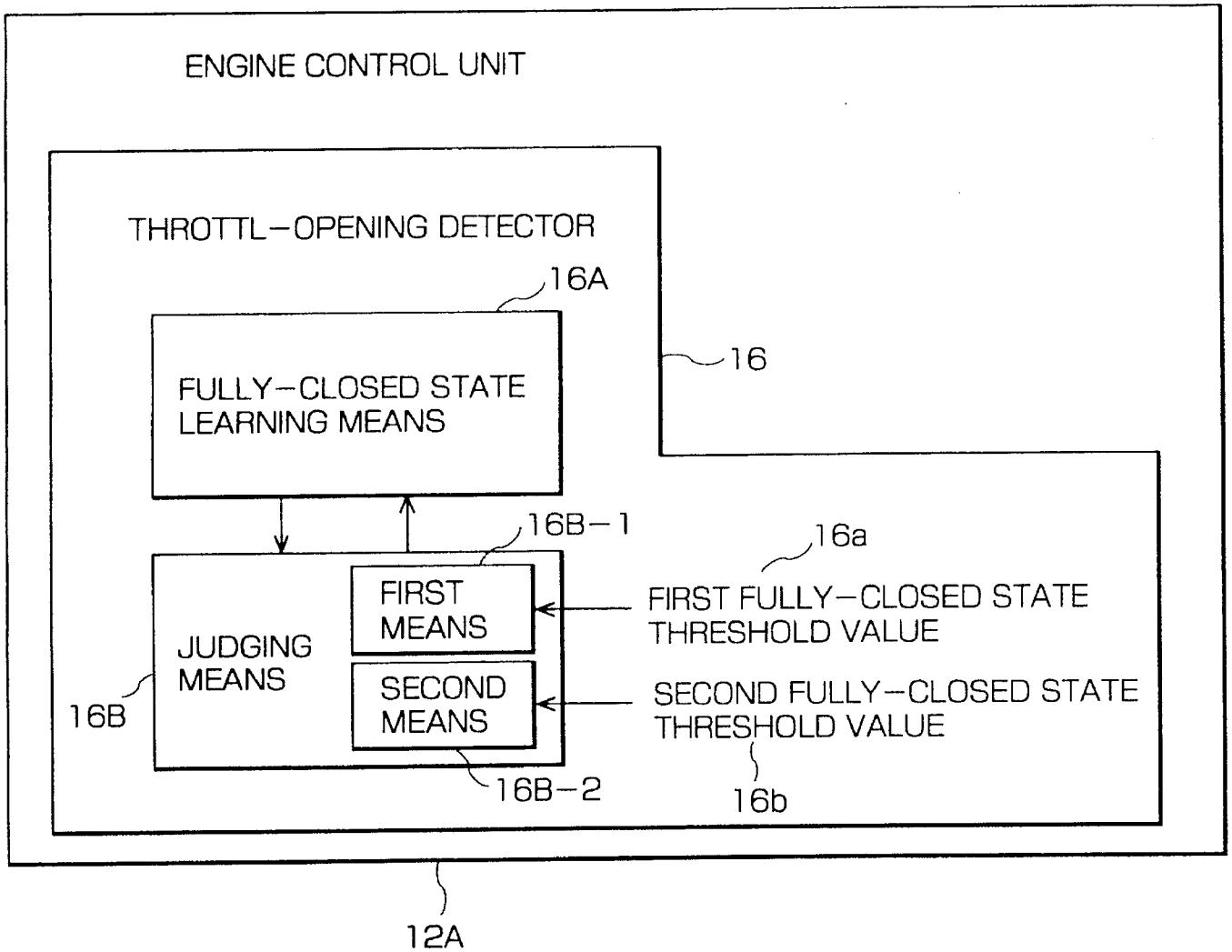
FIG. 1 is a block diagram showing the control unit of an engine in which a throttle-opening detector of the present invention is incorporated.
Figure 6:
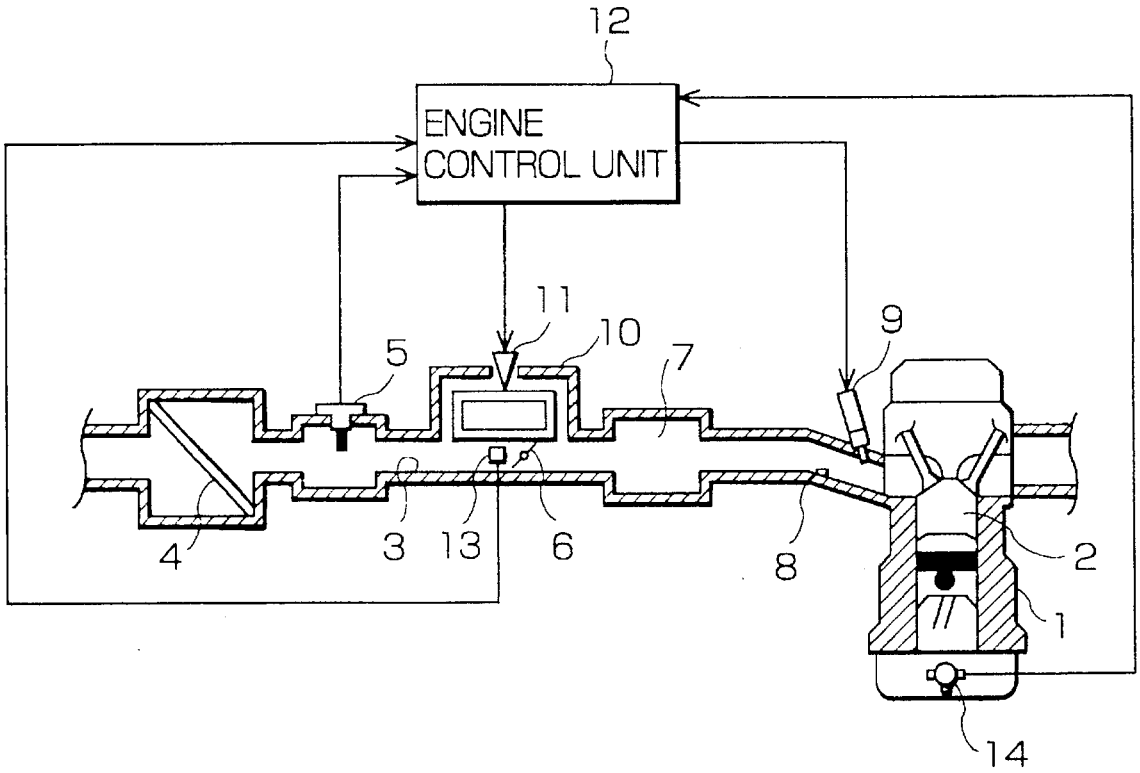
FIG. 6 is a sectional view showing an engine with a conventional throttle-opening detector.

In FIG. 1, a throttle-opening detecting apparatus constructed in accordance with the principles of the present invention is generally designated at a reference numeral 16 and incorporated in an engine control unit 12A corresponding to the engine control unit 12 shown in FIG. 6. The throttle-opening detecting apparatus 16 is comprised of fully-closed state learning means 16A for storing and updating the minimum value of an output of a throttle-opening sensor as a learned value for the fully closed state of the throttle valve, and judgment means 16B for judging the fully closed state of the throttle valve, based on comparison of the throttle-opening sensor output and the fully-closed state learned value.

The judgment means 16B includes first means 16B-1 which obtains a first fully-closed state judging value by adding a first fully-closed state threshold value 16*a* (X1) to the fully-closed state learned value obtained by the fully-closed state learning means 16A and which judges the throttle valve as being in the fully closed state when the throttle-opening sensor output is less than the first fully-closed state judging value. The judgment means 16B further includes second means 16B-2 which obtains a second fully-closed state judging value by adding a second fully-closed state threshold value 16*b* (X2) greater than the first fully-closed state threshold value 16*a* (X1) to the fully-closed state learned value obtained by the fully-closed state learning means 16A and where, when the throttle-opening sensor output is greater than the first fully-closed state judging value and less than the second fully-closed state judging value, the throttle valve is judged as being in the fully closed state after the passage of a predetermined time, as described later.

Figure 2:
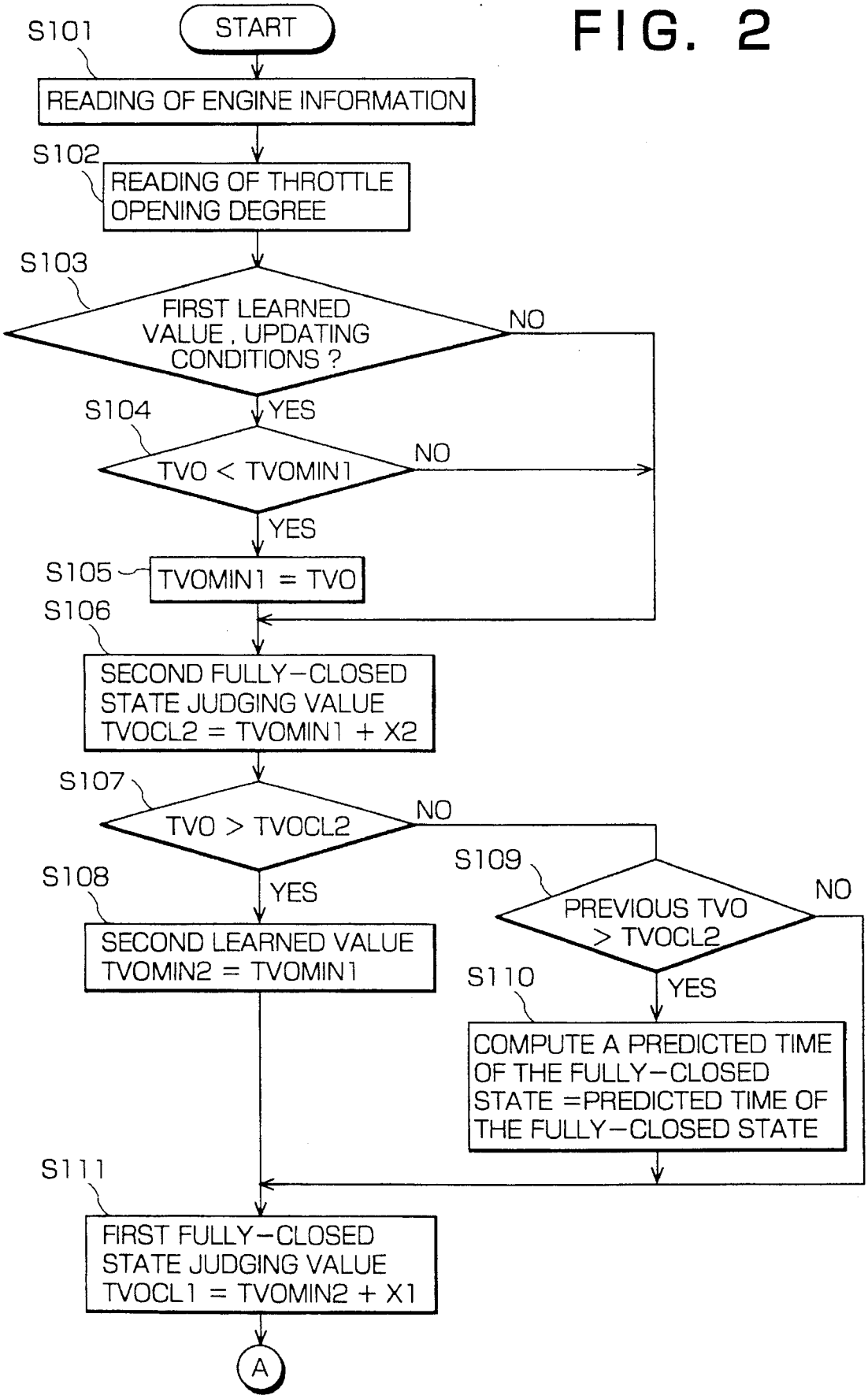
FIG. 2 is a flowchart showing how the throttle-opening detector is operated.
Figure 3:
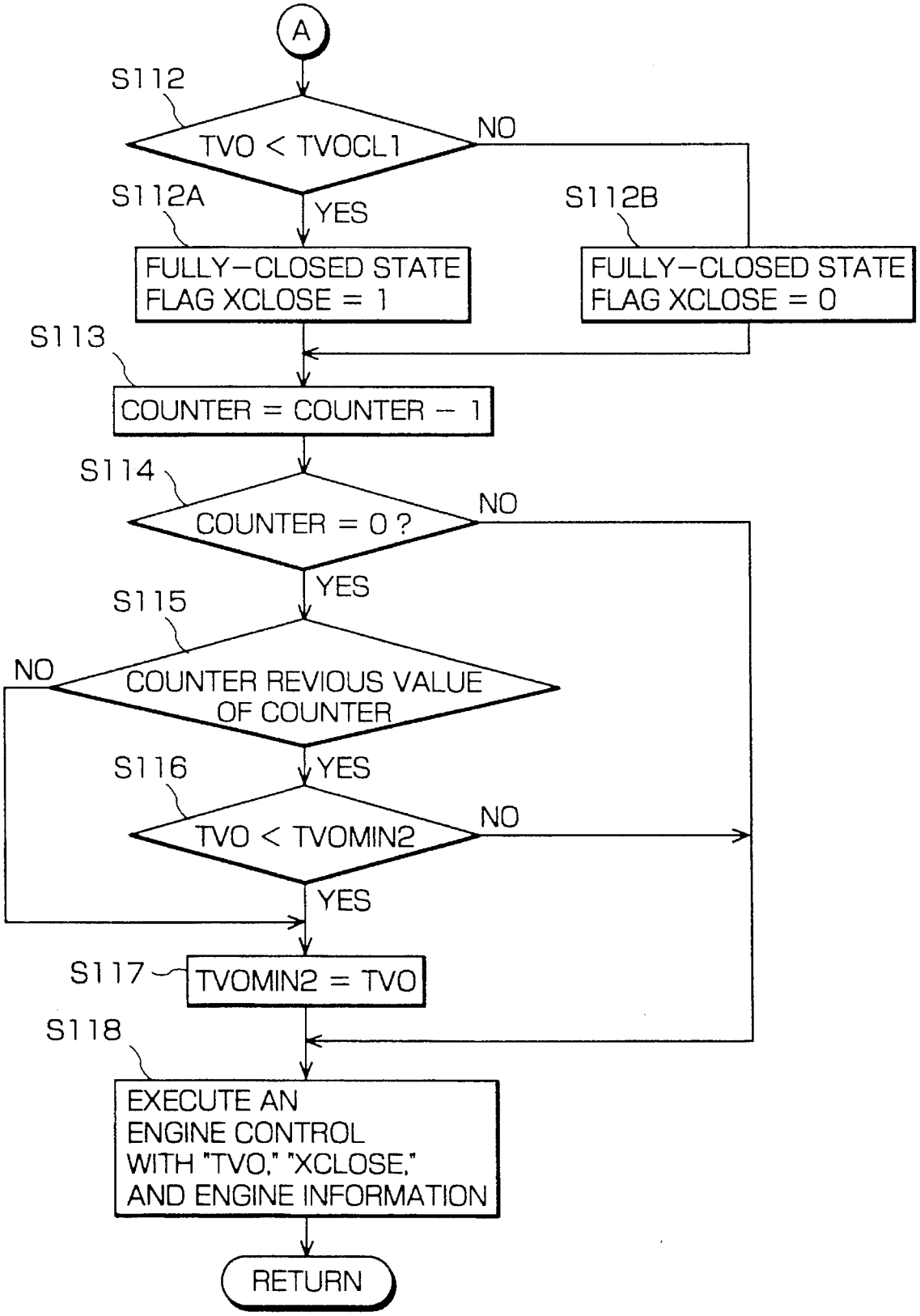
FIG. 3 is a flowchart following FIG. 2.

FIGS. 2 and 3 shows flowcharts for explaining how the throttle-opening detecting apparatus of the present invention operates.

In step S101, engine information, such as the engine speed and the battery voltage, is read in. In step S102 the degree of opening of the throttle valve, TVO, is read in. In step S103, whether the first fully-closed state learned value (hereinafter referred to as a first learned value) is updated is judged based on the information read in step S101 and step S102. To avoid mistaken learning, the updating conditions used are, for example, (1) the variations of the engine speed and the battery voltage have small variations and are within a predetermined value, and (2) the variation of the degree of the opening of the throttle valve is a small and is less than a predetermined value. If the updating conditions are met, step S103 will advance to step S104.

In step S104 the throttle opening degree is compared with the first learned value TVOMIN1. If the throttle opening degree is less than the first learned value TVOMIN1, then step S104 will advance to step S105. In step S105 the present throttle opening degree is set to the first learned value TVOMIN1. If the judgment results in step S103 and step S104 are "NO," step S103 and step S104 will advance to step S106. Steps S103 to S105 are steps for updating the first learned value.

Figure 7:
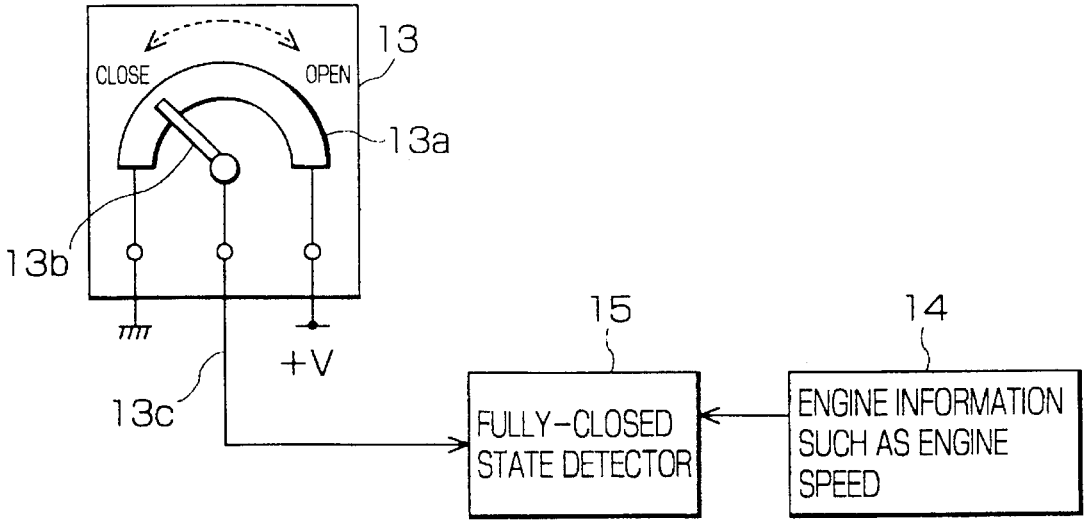
FIG. 7 is a block diagram showing a conventional fully-closed state detector.

In step S106 the fixed value X2 is added to the first learned value TVOMIN1 and the added value is set to the second fully-closed state judging value TVOCL2. The fixed value is a value for setting the fully-closed state judging value to a higher valve in view of all of the structures of the throttle valve and the throttle-opening sensor, the variations of the output of the fully closed sensor caused by material, and the variations of temperature and a change with the passage of time. The second fully-closed state judging value TVOCL2 thus obtained corresponds to the fully-closed state judging value of the conventional detector of FIG. 7.

In step S107 the throttle opening degree TVO is compared with the second fully-closed state judging value TVOCL2. If the throttle opening degree TVO is greater than the second fully-closed state judging value TVOCL2, then step S107 will advance to step S108. In step S108 the second fully-closed state learned value TVOMIN2 (hereinafter referred to as a second learned value) is updated to the first learned value TVOMIN1. If, on the other hand, the throttle opening degree TVO is less than the second fully-closed state judging value TVOCL2, step S108 will advance to step S109.

If in step S109 the previous throttle opening degree TVO is greater than the second fully-closed state judging value TVOCL2, then step S109 will advance to step S110. In step S110 a timer-value prediction time of the fully-closed state is computed at the second fully-closed state judging value TVOCL2. The predicted time of the fully-closed state is computed from the variation quantity of the throttle-opening sensor output or the operating state of the engine. As a computation method, the predicted time of the fully-closed state is computed, for example, from the present throttle opening degree TVO(i) and the previous throttle opening degree TVO(i−1) by the following equation:

$$\text{Predicted time of the fully-closed state}=(TVO(i)-TVOMI1)/(TVO(i-1)-(TVO(i))\times\text{processing cycle time of FIG. 2}$$

In addition, when the engine speed is high where the throttle valve is almost fully closed, the predicted time of the fully-closed state may be set longer at a low speed area and shorter at a high speed area, based on the engine speed, because the negative pressure of the intake manifold is high and the force fully closing the throttle valve is strong. The change of the length of the predicted time of the fully-closed state can be determined so as to be inversely proportional to the engine speed, for example. Furthermore, because when the vehicle in the idling state is in the stopped state, there is the possibility that the engine stalls, the vehicle speed is detected and then the predicted time of the fully-closed state may be set shorter when it is judged that the vehicle is in the stopped state, and the predicted time of the fully-closed state time be set loner when it is judged that the vehicle is not in the stopped state. The predicted time of the fully-closed state thus computed is set to a COUNTER which is a fully-closed state judgment timer.

In step S111 the fixed value X1 is added to the second learned value TVOMIN2 and the added value is set to the first fully-closed state judging value TVOCL1, and then step S111 advances to step S112 shown in FIG. 3. The fixed value X1 is set to a predetermined value which is less than the fixed value X2. The predetermined value is beforehand set by taking account of the frequency of the output values of the throttle-opening sensor (real ability value). In step S112 the throttle opening degree TVO is compared with the first fully-closed state judging value TVOCL1. If the throttle opening degree TVO is less than the first fully-closed state judging value TVOCL1, then step S112 will advance to step S112A. In step S112A a fully-closed state flag XCLOSE is set to "1." If, on the other hand, the throttle opening degree TVO is greater than the first fully-closed state judging value TVOCL1, step S112 will advance to step S112B. In step S112B the throttle valve is judged as not being in the fully closed state and the fully-closed state flag XCLOSE is set to "0".

In step S113 the COUNTER is set to a value equivalent to the previous value minus 1 (COUNTER−1) so that it is decremented down to "0" each time step S113 is performed. In step S114 it is judged whether the value of the COUNTER is "0". If the COUNTER is not "0", then step S114 will advance to step S118. If, on the other hand, the COUNTER is "0", step S114 will advance to step S115. In step S115 it is judged whether the previous value of the COUNTER is "0". If the previous value is not "0", step S115 will advance to step S117. In step S117 the throttle opening degree TVO is set to the second learned value TVOMIN2. When the routine of FIGS. 2 and 3 is processed next time, the throttle valve is judged as being in the fully closed state in step S112 and step S112A, because the first fully-closed state judging value TVOCL1 has been updated in step S111. Also, the COUNTER becomes an initial value for setting the minimum value of the throttle opening degree to the second learned value TVOMIN2 after the COUNTER becomes "0". If, on the other hand, the previous value of the COUNTER is "0", step S115 will advance to step S116. In step S116 the throttle opening degree TVO is compared with the second learned value TVOMIN2. If the throttle opening degree TVO is less than the second learned value TVOMIN2, step S116 will advance to step S117. In step S117 the throttle opening degree TVO is updated as the second learned value TVOMIN2.

Although a detailed description of step S118 will not be given, the control of the engine is performed with the throttle opening degree TVO and the flag XLOSE. The flowcharts of FIGS. 2 and 3 are processed at intervals of a predetermined time.

Now, the operation and advantages of the present invention will be described in reference to FIGS. 4 and 5.

Figure 4:
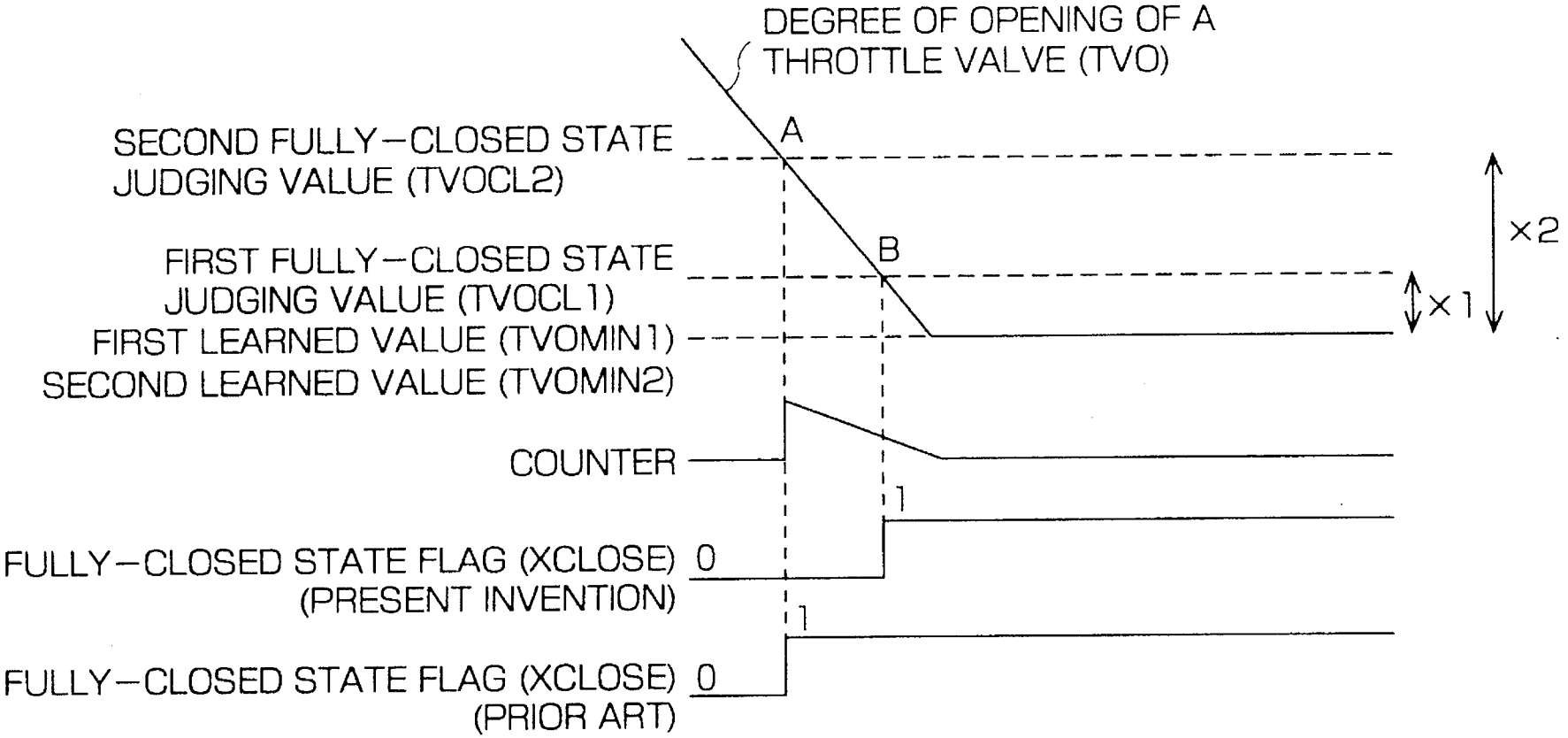
FIG. 4 is a timing diagram showing how the throttle-opening detector is operated.

FIG. 4 shows the case where the throttle valve is closed and where the fully closed point of the throttle valve becomes equal to the first learned value and therefore the fully closed state of the throttle valve is judged. As evident in the fully-closed state flags XCLOSE, it is found that a throttle-opening point A for judging a fully closed state, which is used in the conventional throttle-opening detector, is higher than a throttle-opening point B of the present invention.

Figure 5:
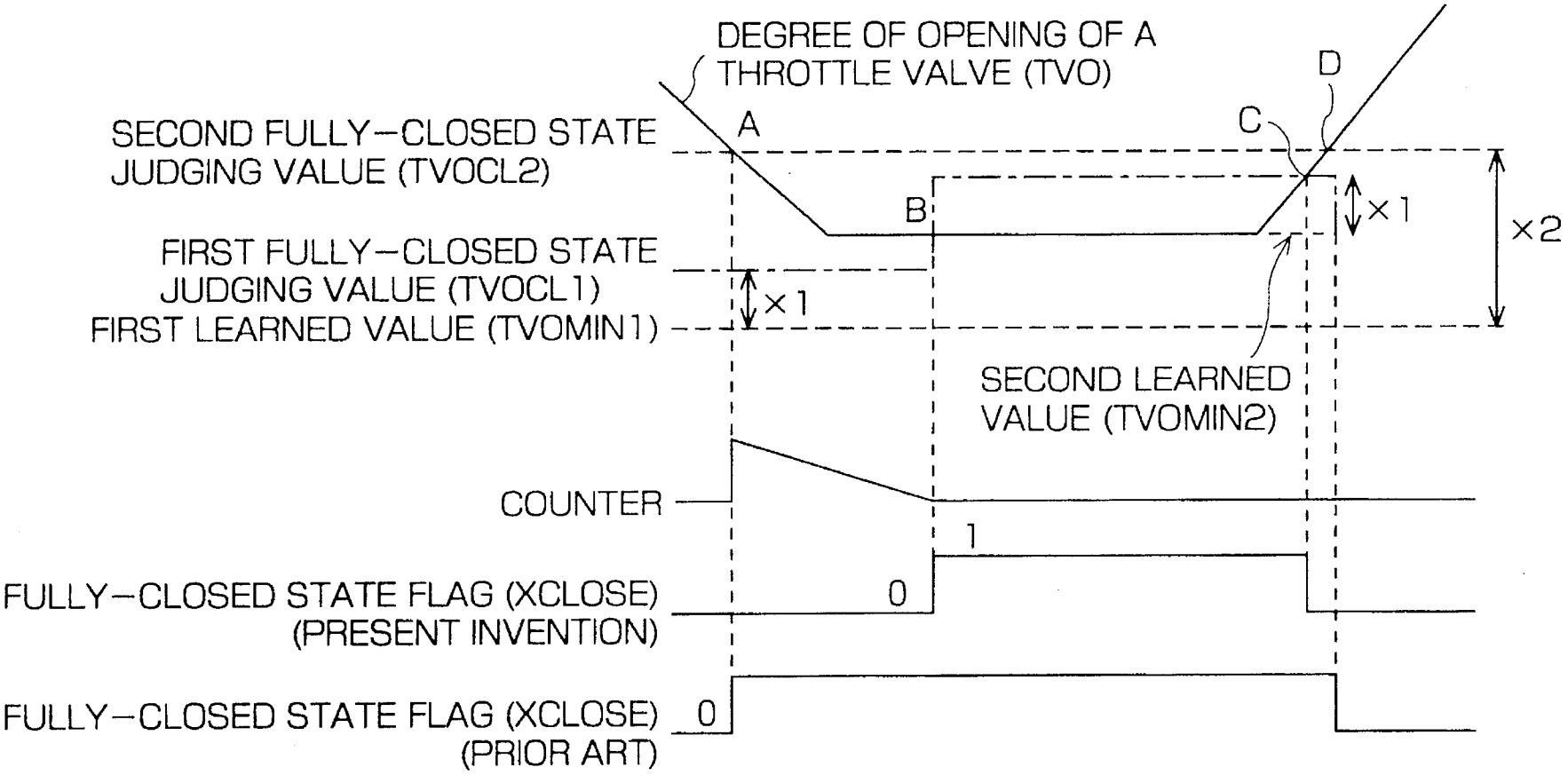
FIG. 5 is a timing diagram showing how the throttle-opening detector is operated.

FIG. 5 shows the case where the throttle is opened and closed when the fully closed state point widely varies due to various overlapped main factors. Even in the case shown in FIG. 5, the throttle-opening point A of the conventional throttle valve becomes higher than the throttle-opening point B of the present invention. It is also found that the judgment of the fully closed state of the present invention is made at a position closer to an actual fully-closed state and that an opening point C of the throttle valve, where the throttle valve gets from the fully closed state to the non-closed state, becomes lower than a conventional opening point D.

While the invention has been described with reference to the preferred embodiment thereof, it is to be understood that modifications or variations may be easily made without departing from the scope of this invention which is defined by the appended claims.

What is claimed is:

1. A throttle-opening detecting apparatus for an internal combustion engine comprising:

a throttle-opening sensor for detecting a degree of opening of a throttle valve and generating a corresponding output signal;

fully-closed state value learning means for storing and updating as a fully-closed state learned value a minimum value of the output of said throttle-opening sensor;

judgment means for judging the fully closed state of said throttle valve based on comparison of said throttle-opening sensor output and said fully-closed state learned value;

said judgment means comprising:

first means for judging said throttle valve as being in the fully closed state when said throttle-opening sensor output is less than a first judging value which is obtained by adding a first threshold value to said learned value; and second means for judging, when said throttle-opening sensor output is greater than said first judging value and less than a second judging value which is obtained by adding a second threshold value to said learned value, said throttle valve as being in the fully closed state after lapse of a predetermined time.

2. The throttle-opening detecting apparatus as set forth in claim 1, wherein, when said throttle-opening sensor output is greater than said first judging value and less than said second judging value, the predetermined time is determined from a difference between the last detected value and the current detected value of said throttle-opening sensor output when the sensor output is less than said second judging value, or from an operating state of the engine.

3. The throttle-opening detecting apparatus as set forth in claim 1, wherein the minimum value of said throttle-opening sensor output, obtained from the time when said throttle valve is judged as being in the fully closed state, is updated as said learned value, and wherein said throttle valve is judged as not being in the fully closed state when the output value of said throttle-opening sensor thereafter is greater than a value obtained by adding the updated learned value to said first threshold value.

4. The throttle-opening detecting apparatus as set forth in claim 3, wherein, when said output value of said throttle-opening sensor becomes greater than said second judging value, said updated learned value is updated to the learned value before said updating.

* * * * *